US012742619B1

(12) United States Patent
Schmalbeck

(10) Patent No.: US 12,742,619 B1
(45) Date of Patent: Sep. 22, 2026

(54) TWO-STAGE MULTIUSE GUN CLEARING AND TEST TRAP WITH REPLACEABLE DECELERANT

(71) Applicant: Timothy Scott Schmalbeck, Rigby, ID (US)

(72) Inventor: Timothy Scott Schmalbeck, Rigby, ID (US)

(73) Assignee: Timothy Scott Schmalbeck, Rigby, ID (US)

( * ) Notice: Subject to any disclaimer, the term of this patent is extended or adjusted under 35 U.S.C. 154(b) by 1024 days.

(21) Appl. No.: 17/453,695

(22) Filed: Nov. 5, 2021

Related U.S. Application Data

(60) Provisional application No. 63/111,894, filed on Nov. 10, 2020.

(51) Int. Cl.
*F41J 13/00* (2009.01)

(52) U.S. Cl.
CPC ..... *F41J 13/00* (2013.01)

(58) Field of Classification Search
CPC ..... F41J 13/00; F41J 9/18; F41J 13/02; F41J 11/00; F41J 11/02
See application file for complete search history.

(56) References Cited

U.S. PATENT DOCUMENTS 1,010,514 A * 12/1911 Mount ..... F41J 13/00 273/410
1,844,581 A * 2/1932 Koehler ..... F41J 13/00 273/410
2,201,527 A * 5/1940 Freeman ..... F41J 13/00 273/404

(Continued)

FOREIGN PATENT DOCUMENTS

CN 1536325 A * 10/2004
CN 201247014 Y * 5/2009

(Continued)

OTHER PUBLICATIONS

"Do bullet traps reduce sound at all?" [online]. Legally Armed America. [Published Feb. 17, 2019]. 1 page. Retrieved from the Internet: https://www.youtube.com/watch?v=jGCnlqS1S7c&t=489s.
"Gun clearing device" [online]. Greenbullettrap.com. [Published Feb. 15, 2019]. 1 page. Retrieved from the Internet: https://www.youtube.com/watch?v=H7m4TkCvbgo.

(Continued)

*Primary Examiner* — John E Simms, Jr.
*Assistant Examiner* — Amir A Klayman
(74) *Attorney, Agent, or Firm* — Weaver Austin Villeneuve & Sampson LLP; Kenneth R. Allen

(57) ABSTRACT

A reusable gun clearing and test trap has two chambers, a bullet capture chamber and an attached bullet inlet chamber to stop fired bullets, the capture chamber having at least one user-serviceable door for interior access to receive a bullet decelerant. An elastomeric mass such as blocks of compressed crumb rubber or vulcanized virgin rubber retardant is removably insertable into the inlet chamber for slowing the fired bullets. A slurry, such as a mixture of sand and oil such as is removably loadable into the capture chamber through a trap door and serves as the decelerant for the fired bullets. The capture chamber and the inlet chamber are made in a shape and of encasing materials that are sufficient to contain explosive discharges and ricochets associated with fired bullets. A labyrinth baffle is for dispersing discharge gases.

6 Claims, 3 Drawing Sheets

(56) References Cited

U.S. PATENT DOCUMENTS 2,356,992 A * 8/1944 Gilson ..... F41J 13/00 188/269
2,420,304 A * 5/1947 Diem ..... F41J 13/00 73/167
2,518,446 A * 8/1950 Benson ..... F41J 13/00 73/167
3,659,649 A * 5/1972 Dunlap ..... E21B 43/2635 166/347
3,982,789 A * 9/1976 Funk ..... B65G 53/30 209/172.5
4,126,311 A * 11/1978 Wagoner ..... F41J 13/00 273/410
4,300,389 A * 11/1981 Tevelow ..... F42B 35/00 73/167
4,436,695 A * 3/1984 Marwick ..... G21C 1/00 976/DIG. 5
4,475,734 A * 10/1984 Clarke, III ..... F41J 13/00 273/410
4,482,027 A * 11/1984 Gould ..... F41J 13/00 181/223
4,509,301 A * 4/1985 Head ..... F41J 13/02 52/79.8
4,690,061 A * 9/1987 Armer, Jr. ..... F42B 8/28 102/407
4,777,753 A 10/1988 Stancato
5,456,155 A * 10/1995 Myrtoglou ..... F41J 13/00 273/410
5,477,733 A * 12/1995 Duarte ..... F41J 13/00 73/167
5,531,113 A * 7/1996 Jamison ..... G01L 5/14 73/167
5,684,264 A * 11/1997 Cassells ..... F41J 13/00 220/495.11
5,715,739 A * 2/1998 White ..... F41J 13/02 273/404
5,718,434 A * 2/1998 Alward ..... F41J 13/00 89/36.02
5,811,718 A * 9/1998 Bateman ..... F41J 13/00 273/404
6,016,735 A * 1/2000 Langner ..... F41J 13/00 89/917
6,128,847 A * 10/2000 Langner ..... F41A 17/54 42/70.07
6,173,956 B1 1/2001 O'Neal
6,311,980 B1 11/2001 Sovine et al.
6,722,195 B2 * 4/2004 Duke ..... F42B 35/00 73/167
6,808,178 B1 * 10/2004 Sovine ..... F41J 13/00 89/36.02
6,837,496 B2 * 1/2005 Larson ..... F41J 13/00 273/410
7,134,233 B1 * 11/2006 Saur ..... F41A 9/60 42/98
7,421,893 B1 * 9/2008 Mann, II ..... F41J 13/00 73/167
9,733,050 B2 * 8/2017 Moberg ..... F41J 13/00
10,422,608 B2 * 9/2019 Yang ..... F41J 13/00
11,112,223 B2 9/2021 Whitworth
D1,065,413 S 3/2025 Thorne
2002/0088339 A1 * 7/2002 Koffler ..... F41J 13/00 89/36.02
2003/0150360 A1 * 8/2003 Huntsman ..... F41J 13/00 106/713
2004/0104533 A1 * 6/2004 Larson ..... F41J 13/00 273/404
2005/0034594 A1 2/2005 Parks et al.
2005/0220686 A1 * 10/2005 Hurley ..... C22B 13/045 423/92
2006/0208424 A1 9/2006 Sovine et al.
2010/0327531 A1 * 12/2010 Bavaro ..... F41J 13/00 273/410
2012/0181752 A1 * 7/2012 Bavaro ..... F41J 13/00 273/410
2012/0187631 A1 * 7/2012 John ..... F41J 13/00 273/410
2015/0084284 A1 * 3/2015 Cibrian Vidrio ..... F41J 13/00 273/410
2017/0234659 A1 * 8/2017 Amidon ..... C04B 28/04 273/410
2019/0093660 A1 * 3/2019 Pemberton ..... F16D 1/101
2019/0234715 A1 * 8/2019 Yang ..... F41J 11/02

FOREIGN PATENT DOCUMENTS

CN 202002551 U * 10/2011
CN 204373522 U * 6/2015
KR 20120034304 A * 4/2012 ..... F41J 1/00
KR 101196679 B1 * 11/2012

OTHER PUBLICATIONS

U.S. Notice of Allowance dated Oct. 20, 2025 in U.S. Appl. No. 29/950,805.
U.S. Appl. No. 29/950,805, inventor Schmalbeck T.S, filed on Jul. 4, 2024.

* cited by examiner

TWO-STAGE MULTIUSE GUN CLEARING AND TEST TRAP WITH REPLACEABLE DECELERANT

RELATED APPLICATIONS

This application claims the benefit of U.S. Provisional Application No. 63/111,894, filed Nov. 10, 2020, entitled "TWO-STAGE MULTIUSE GUN CLEARING AND TEST TRAP WITH REPLACEABLE DECELERANT", which is assigned to the assignee hereof, and incorporated herein in its entirety by reference.

BACKGROUND

Field of Invention

This invention relates to an apparatus for test firing firearms and clearing bullets from firing chambers, also known as a gun clearing trap. Specifically, this invention relates to a low cost, reusable and user serviceable apparatus.

Description of Prior Art

Gunsmiths and other firearms users may safely verify unloaded firing chambers and test fire firearms by employing gun clearing traps or gun test traps into which bullets may be fired. Clearing traps are particularly useful to assure that bullet cartridges are cleared from firing chambers and are thus an important safety device.

Many known clearing traps are essentially single-use or limited-lifetime devices. Commercially available clearing/test traps can be prohibitively expensive, inconveniently bulky, have a limited useful life and are not intended to be user-serviceable.

An example of a known gun clearing trap is U.S. Pat. No. 8,827,273, which discloses one solution and describes some of the known prior art, including use of rubber and metal to impede and slow fired bullets.

What is needed is a relatively low-cost, small footprint, user-serviceable and reusable gun clearing trap or test trap.

SUMMARY OF THE INVENTION

According to the invention, a reusable gun clearing and testing trap is provided that has two chambers, namely, a bullet capture chamber and an attached bullet inlet chamber, to stop fired bullets, the capture chamber having a trap door for interior access to receive a bullet decelerant. An elastomeric mass such as blocks of compressed crumb rubber or vulcanized virgin rubber retardant is removably insertable into the inlet chamber for slowing the fired bullets. A slurry, such as a mixture of sand and hydraulic oil is removably loaded into the capture chamber through a trap door and serves as the decelerant for the fired bullets. The capture chamber and the inlet chamber are made in a shape and of encasing materials that are sufficient to contain explosive discharges and ricochets associated with fired bullets. The decelerant may be contained in a cartridge. A labyrinth baffle is for dispersing discharge gases.

The invention will be better understood by reference to the following Description of Specific Embodiments and accompanying Drawings.

DRAWINGS

DESCRIPTION OF SPECIFIC EMBODIMENTS

Figure 1:
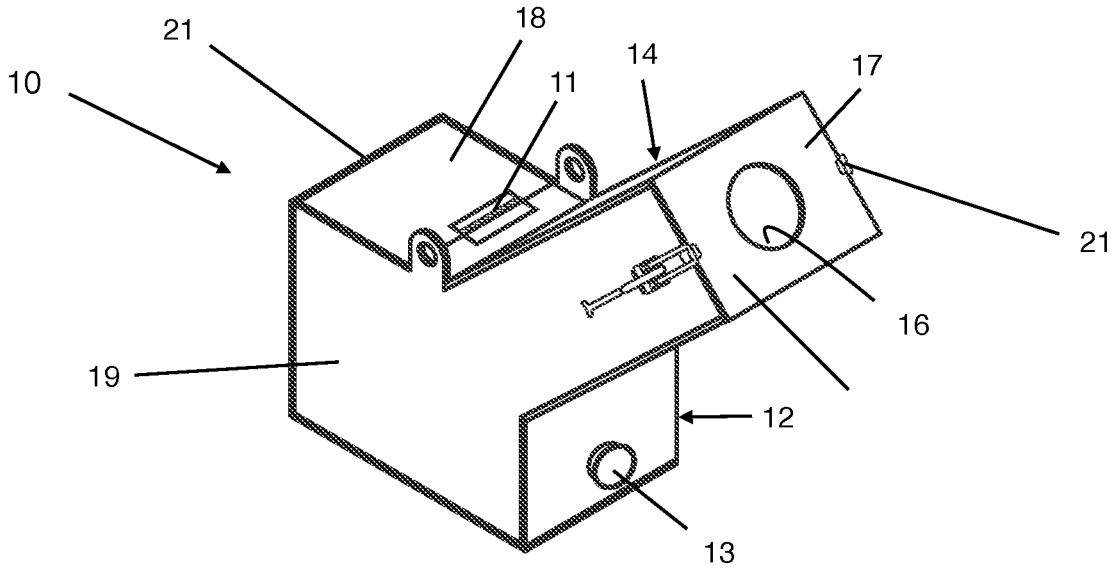
FIG. 1 is a perspective view of one embodiment of the invention.
Figure 2:
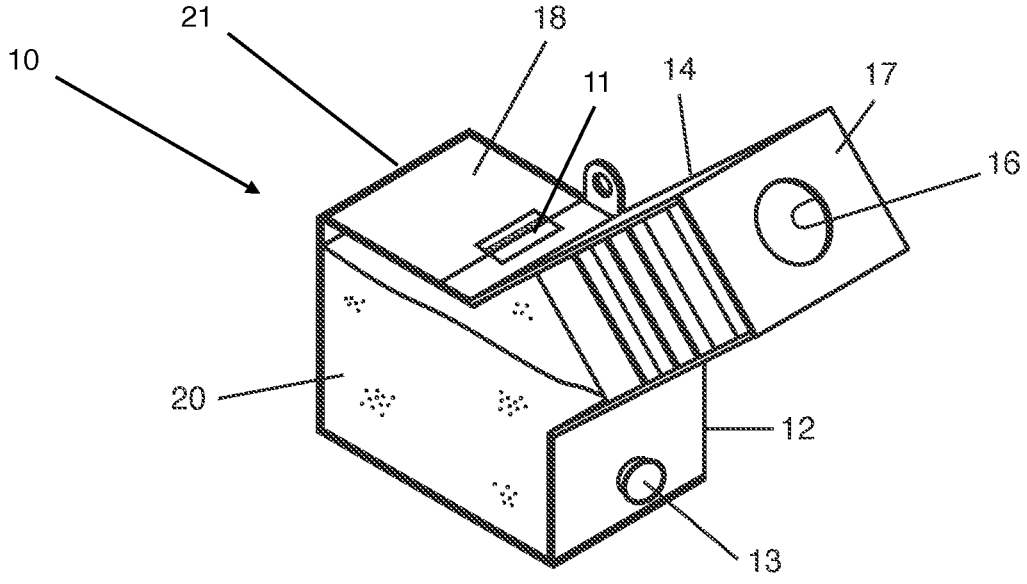
FIG. 2 is a perspective cutaway view of the embodiment of FIG. 1.
Figure 3:
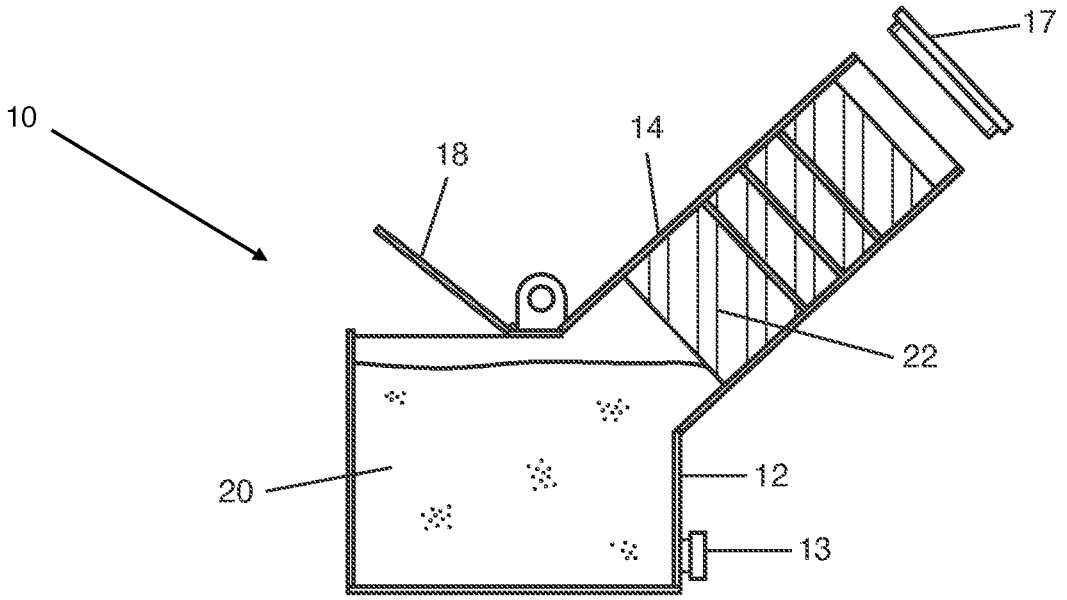
FIG. 3 is a side cutaway view of the embodiment of FIG. 1.

Referring to FIG. 1, FIG. 2 and FIG. 3, a reusable gun clearing trap 10 is shown. It has two chambers, a bullet capture chamber 12 and an attached bullet inlet chamber 14, which together are intended to stop bullets fired into the inlet chamber 14, typically through an inlet port 16 large enough to receive a gun muzzle in a cap 17.

A first service door 18 is provided on top of the capture chamber 12 for access. The service door 18 may be held by a hinge 11 so that it opens toward the back end or rear of the capture chamber to receive a bullet decelerant 20. The decelerant 20 according to the invention is a slurry, as herein explained. A second service door (or doors) 19 may be provided on the side of the capture chamber 12 for use as herein explained. The service doors 18, 19 may be secured by compression clamps 21 (not all shown) to ensure the capture chamber 12 remains closed under fire.

Figure 4:
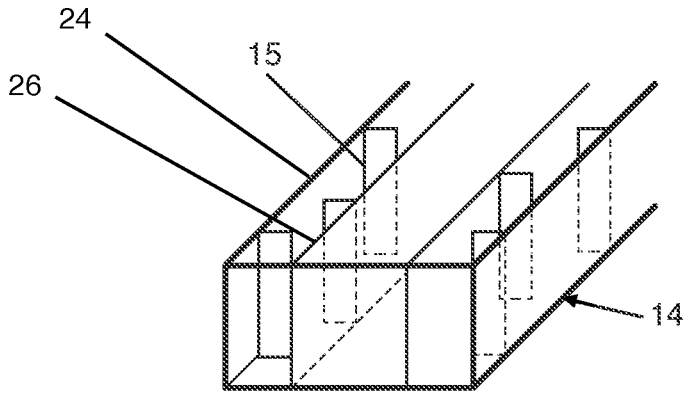
FIG. 4 is a perspective cutaway view of portion of a bullet inlet chamber showing a labyrinth baffle structure.
Figure 5:
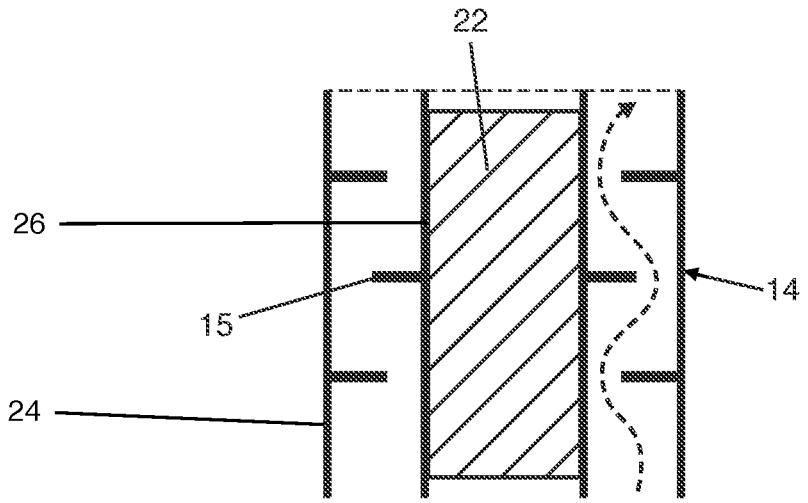
FIG. 5 is a side cutaway view of portion of a bullet inlet chamber showing the labyrinth baffle structure and elastomeric retardant.

Referring to FIG. 2 and FIG. 3, an elastomeric mass 22 such as blocks of compressed crumb rubber or vulcanized virgin rubber is removably insertable into the inlet chamber 14 for initially slowing fired bullets, as well as to absorb some of the shock of a discharge. To this end the inlet port cap 17 may be removable to service the contents. Referring to FIG. 4 and FIG. 5, the inlet chamber 14 has two layers 24, 26 forming double thick walls with baffle plates 15 within the layers to baffle the explosive pressurized discharge gases. Each layer 24, 26 is preferably constructed of welded AR 500 steel, each one quarter inch or more in thickness with an air gap. The outer layer 24 may be vented. Other materials and shapes may be used without departing from the spirit and scope of the invention so long as there are two areas for replaceable retardant 22 and decelerant 20.

The slurry decelerant 20 according to the invention is preferably a mixture of rough sand and oil, preferably hydraulic oil as herein explained according to the invention. The advantage of a slurry is that it exhibits non-Newtonian force-response to motion properties when pressure is applied. More preferably the slurry is a mixture of hydraulic oil and sand in the range of 0.0625 mm grains to 2 mm grains and the hydraulic oil is preferably 32 AW hydraulic oil. The sand and oil are mixed together in a ratio of between 0.05 to 1 and 20 to 1 parts by volume and most preferably about 0.05 part by volume of common sandbox sand (medium coarse non binding) sand to 1 part by volume of 32 AW hydraulic oil. In practice that is a 50 lb. bag of sand with 5 quarts of 32 AW hydraulic oil. Alternatively, previously used 46 AW, 50 AW or 68 AW hydraulic oils and any available nonbinding sand can be used. The resultant properties of the slurry cause the sand particles and oil of the slurry decelerant 20 absorb impact enough to allow a bullet to penetrate but not traverse the slurry decelerant 20.

Figure 6:
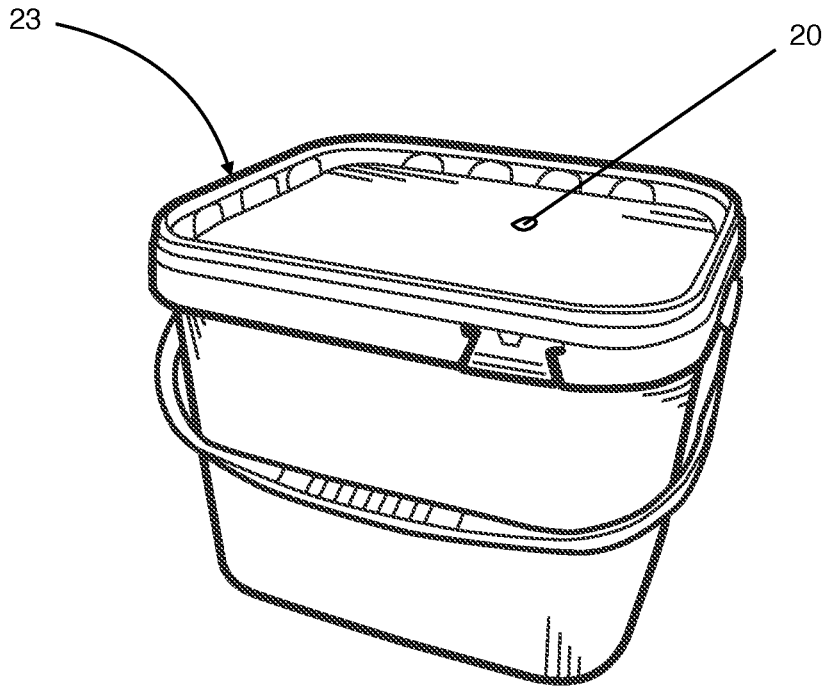
FIG. 6 is a perspective view of a container or cartridge for containing a slurry decelerant.

Referring to FIG. 6, the slurry decelerant 20 may be premixed and secured in a non-permeable but penetrable container 23. The container 23 may be of plastic sheeting, heavy paper, fabric or thin metal, for example, forming a replaceable cartridge of a size and shape that can be removably insertable into the capture chamber 12 through one or both of the service doors 18, 19. (The side service door 19 is typically larger than the top service door 18 and thus can accommodate a larger volume slurry cartridge.) When the slurry has been considered expended, bullets can be recovered and the slurry can be disposed of like used motor oil.

Absent a cartridge, the slurry decelerant 20 can be formed in place by pouring sand into the capture chamber 12 and adding oil through the tops service doors 18 to soak the sand. The service door is typically on the top side of the capture chamber 12 in a position not in the line of fire of a bullet or ricochet. The capture chamber 12 and the inlet chamber 14 are constructed in a shape and of encasing materials that are sufficient to contain the pressure of explosive discharges and if necessary ricochets associated with fired bullets. To this end the axis or line of fire through the inlet chamber 12 is positioned and angled relative to the inner facing walls (back and bottom) of the capture chamber 12 so that in the unlikely event that a bullet manages to traverse the inlet chamber 14 and the capture chamber 12 through any material, it is not deflected back toward the inlet chamber 14, even in the absence of decelerant 20. For example, the inner walls could be angled to ricochet many times within the capture chamber 12 and/or to direct fire into a secondary port, such as a screened port against the ground that might otherwise be used to remove the slurry or even spent bullets.

A properly prepared system according to the invention has been tested and found to be extremely effective in trapping high-energy projectiles. The rubber block first slows projectiles as they pass through the rubber block and then the projectiles are stopped in the sand/oil slurry. In testing, the combination of the rubber block and sand/oil slurry stopped 0.50 BMG rounds. Specifically when rounds were fired into the rubber block at point blank, all 0.50 BMG rounds stopped within 4 inches penetration of the sand/oil slurry. It was proved that fired projectiles will not bounce off of this formulation of sand/oil slurry. In this formulation, the sand grain size allows initial penetration and the slurry absorbs the energy, thereby stopping the projectile with controlled penetration. The capture chamber 12 is effective in containing any splashing.

The invention has now been explained in reference to specific embodiments. Other embodiments will be apparent to those of ordinary skill in the art, Therefore, it is not intended that this invention be limited, except as indicated by the appended claims.

What is claimed is:

1. A gun clearing and test trap comprising:

a capture chamber containing the slurry and operative to capture fired bullets;

an inlet chamber connected to said capture chamber and together forming the clearing/test trap, said inlet chamber having an inlet port for receiving fired bullets, said inlet chamber further having two layers of wall forming a passageway from the capture chamber to an outlet and further including a baffle in said passageway to constrain discharge gases;

an elastomeric mass removably insertable into said inlet chamber for slowing fired bullets, wherein the elastomeric mass further partially absorbs a discharge shock of a fired bullet;

a slurry, the slurry being a mixture of sand and liquid petroleum of a ratio, volume and viscosity sufficient to stop fired bullets, the liquid petroleum being hydraulic oil and the sand being of a size in the range of 0.0625 mm grains to 2 mm grains, the hydraulic oil and sand being mixed together in a ratio of between 0.05 to 1 parts and 20 to 1 parts by volume, wherein the slurry exhibits a non-Newtonian force-response to motion properties; and wherein the capture chamber and the inlet chamber are constructed of encasing materials sufficient to contain explosive discharges associated with fired bullets.

2. The trap according to claim 1, wherein the encasing materials comprise AR500 Ballistic Steel.

3. The trap according to claim 1, wherein the elastomeric mass is at least one of compressed crumb rubber block or vulcanized virgin rubber block.

4. The trap according to claim 1, wherein the slurry is contained in a cartridge removably insertable into said capture chamber.

5. The trap according to claim 1, wherein the liquid petroleum is 32 AW, 46 AW, 50 AW or 68 AW hydraulic oil.

6. A gun clearing and test trap comprising:

a slurry, the slurry being a mixture of sand and liquid petroleum of a ratio, volume and viscosity sufficient to stop fired bullets, the slurry being about 0.05 parts by volume of 32 AW hydraulic oil to one part by volume of common sandbox sand, and wherein the slurry exhibits a non-Newtonian force-response to motion properties;

a capture chamber containing the slurry and operative to capture fired bullets;

an inlet chamber connected to said capture chamber and together forming the clearing/test trap, said inlet chamber having an inlet port for receiving fired bullets, said inlet chamber further having two layers of wall forming a passageway from the capture chamber to an outlet and further including a baffle in said passageway to constrain discharge gases;

an elastomeric mass removably insertable into said inlet chamber for slowing fired bullets, wherein the elastomeric mass further partially absorbs a discharge shock of a fired bullet; and wherein the capture chamber and the inlet chamber are constructed of encasing materials sufficient to contain explosive discharges associated with fired bullets.

* * * * *